US005297572A

United States Patent [19]

Kuo

[11] Patent Number: 5,297,572

[45] Date of Patent: Mar. 29, 1994

[54] IMPROVED FRAMES OF A FOLDED UMBRELLA

[76] Inventor: Cheng M. L. Kuo, 18, Alley 15, Lane 582, Sea Ta Road, Hsinchu, Taiwan

[21] Appl. No.: 56,790

[22] Filed: May 4, 1993

[51] Int. Cl.[5] ..... A45B 19/00

[52] U.S. Cl. ..... 135/25.3; 135/31

[58] Field of Search ..... 135/25.30, 29, 31, 25.31, 135/25.32, 25.33

[56] References Cited

U.S. PATENT DOCUMENTS

| | | | |
|---|---|---|---|
| 3,893,467 | 7/1975 | Wingen | 135/25.3 |
| 3,896,833 | 7/1975 | Weber | 135/25.3 |
| 3,901,257 | 8/1975 | Schafer | 135/25.3 |
| 4,030,515 | 6/1977 | Weber | 135/25.3 |
| 4,077,421 | 3/1978 | Schultes et al. | 135/25.3 |
| 5,048,550 | 9/1991 | Su | 135/25.3 |
| 5,063,953 | 11/1991 | Wu | 135/25.3 |

*Primary Examiner*—Carl D. Friedman
*Assistant Examiner*—Lan C. Mai
*Attorney, Agent, or Firm*—Morton J. Rosenberg; David I. Klein

[57] ABSTRACT

A folding umbrella frame is provided which includes an improved frame linkage having a second stick with a recess formed within it and an inclined outer end pivotally secured to a fourth rib member. A first stick member is coupled to a first rib member and includes a second end which is inclined and is pivotally secured to a third rib member. The first rib member has an end which is inclined for pivotal coupling to a central section of a second rib member. The inclined ends of the first rib member, the first stick member and the second stick member reduces the force required to open and close the folding umbrella while the recess receives an end of the first rib member to reduce the volume of the umbrella when in a closed state.

1 Claim, 3 Drawing Sheets

IMPROVED FRAMES OF A FOLDED UMBRELLA

BACKGROUND OP THE INVENTION

There are many kinds of prior art folding umbrellas which include central shafts and sets of frame linkages. Known folding umbrellas should be used with ease and have a small volume when closed. Prior art systems are exemplified for example in U.S. Pat. Nos. 4,739,783 and 4,676,262. In such systems the frame linkages consist of several straight ribs and sticks. When the frame linkage is folded, the end of the first rib will be convexly deformed and resists the movement of the second stick. Thus, the outer ribs and sticks cannot be effectively and easily moved inwardly while the whole umbrella occupies a larger volume than necessary.

SUMMARY OF THE INVENTION

It is an object of the present invention to mitigate and/or obviate the above-mentioned drawbacks and disadvantages of prior art controlling mechanisms for folding umbrellas in the manner set forth in the Description of the Preferred Embodiment.

A primary object of the present invention is to provide an umbrella which includes an improved frame having a new design of the second stick for receiving the first end of the first rib, the first slick for receiving an end of a third rib member and a first rib member end that makes the outer ribs and sticks of the frame easily moved inwardly and reduces the volume of the closed umbrella.

Another object of the present invention is to provide an improved frame having the first stick, second stick, and first rib member formed with inclined outer ends for changing a vertically directed force to a laterally directed force which makes the opening of the umbrella easier and more convenient to the user.

Further objects and advantages of the present invention will become apparent as the following description proceeds, and the features and novelty are characterized in the claims annexed to and forming a part of this invention.

DESCRIPTION OF THE PREFERRED EMBODIMENTS

Figure 1:
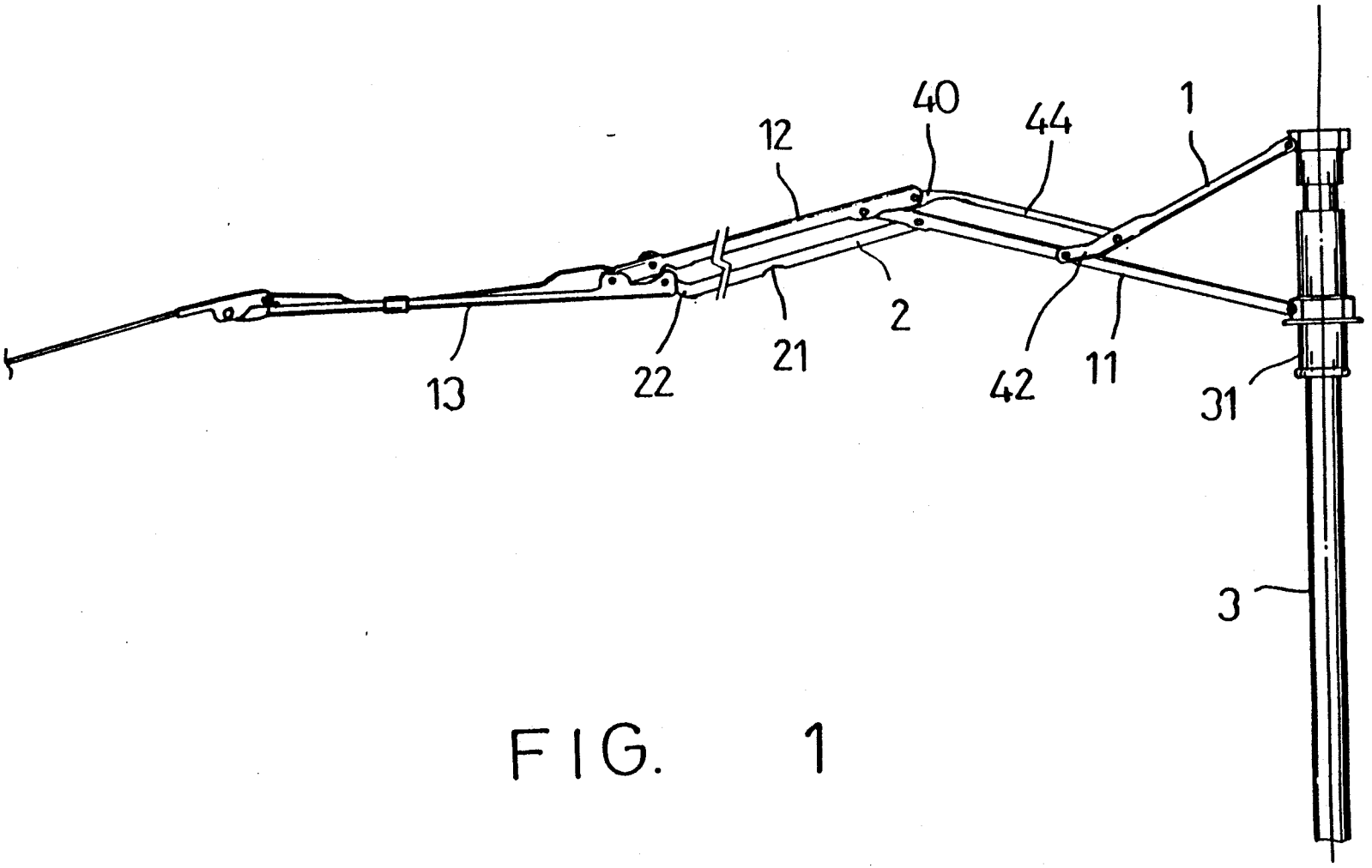
FIG. 1 is an elevational view showing an umbrella opened state according to the present invention.
Figure 2:
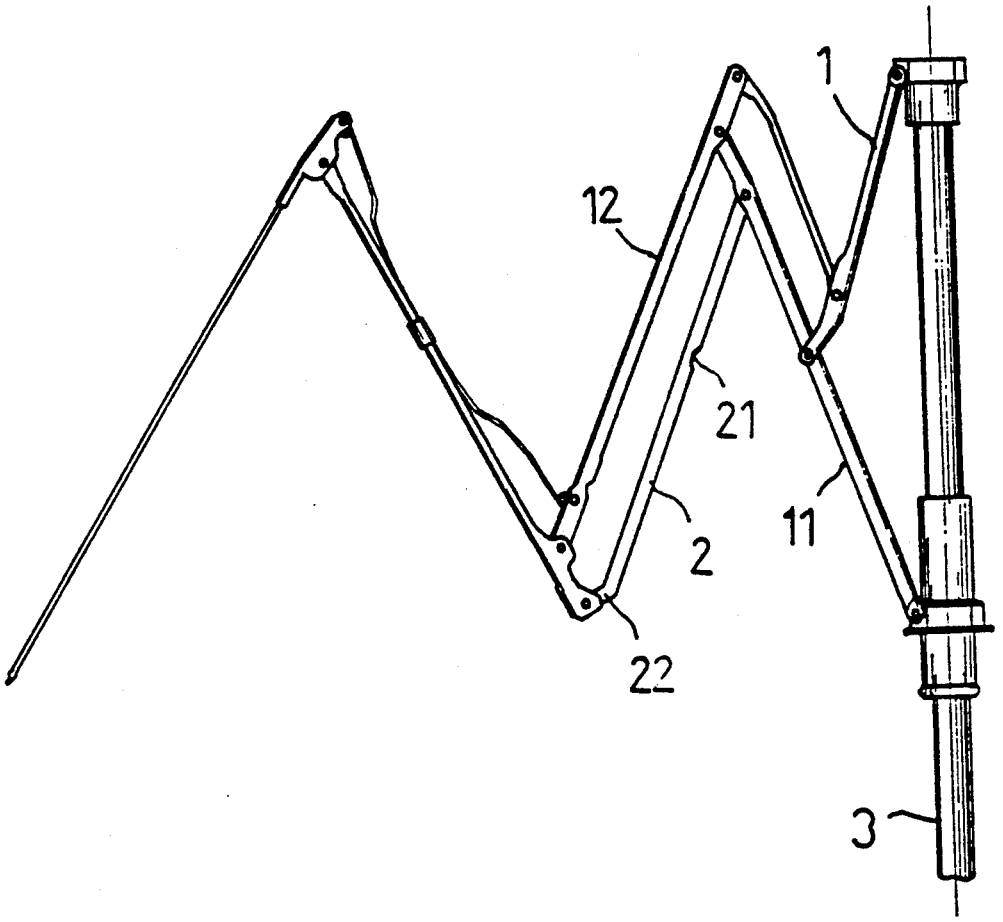
FIG. 2 is an elevational view of an umbrella showing a semi-opened state according to the present invention; and, FIG. 3 is an elevational view of an umbrella showing a closed state according to the present invention.
Figure 3:
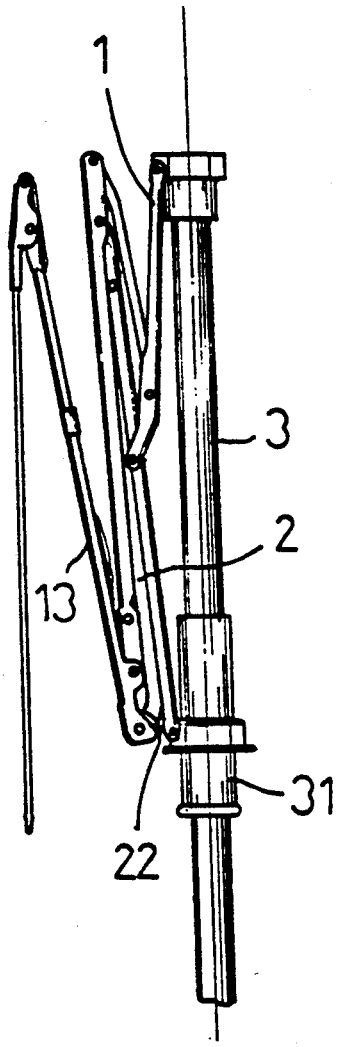

Referring now to FIGS. 1-3, there is shown a folding umbrella frame having the known shaft 3 and displaceable runner 31 with a set of frame linkages. The frame includes a first rib 1 pivotally connected at an inner end with the top of the shaft 3 and includes inclined outer end 42 pivotally coupled with a central section of a second rib 11 which is pivotally coupled at an inner end with a runner 31 slidable on the shaft 3 in a vertical direction and includes an outer end pivotally coupled to a third rib 12 and a second stick 2. An outer end of the second stick 2 is inclined and is pivotally coupled to an inner end of the fourth rib 13.

A first stick 44 is pivotally coupled to the first rib member 1 on an inner end and includes an inclined outer end 40 pivotally connected to third rib 12.

The characteristic of the present invention is the design of the combined second stick 2, first stick 44 and first rib 1 which includes respective outer inclined ends 22, 40 and 42 for transforming vertical force to lateral forces as well as providing recess 21 in stick 2 for reducing the overall volume of the umbrella in a closed state.

During the closing of the umbrella as shown in FIGS. 1-3, the outer end of the first rib 1 is inclined forming an extending projection which is insertable within recess 21 formed in second stick 2 when the umbrella is closed completely. Due to this engagement, the outer ribs 12 and 13 and sticks 2 and 4 are able to be held inwardly and reduce the total volume of the umbrella.

Moreover, when the umbrella is to be opened, the runner 31 is moved vertically or upwardly on shaft 3. In prior systems, the vertical force is excessive to laterally expand the frame members. Referring to FIG. 3, it can be seen that the inclined ends 22, 40 and 42 of respective sticks 2, 44 and rib 1 are able to easily transform upward force to a lateral direction force and reduces the necessary opening force applied to the umbrella.

As various possible embodiments may be made of the above invention without departing from the scope of the invention, it is to be understood that all matter herein described or shown in the accompanying drawings is to he interpreted as illustrative and not in a limiting sense. Thus, it will be appreciated that the drawings are exemplary of a preferred embodiment of the invention.

I claim:

1. A folding umbrella frame having a shaft and a runner slidably displaceable on said shaft comprising:

(a) a first rib member having opposing first and second ends, said first end of said first rib member being pivotally coupled to a top end of said shaft, said second end of said first rib member being inclined with respect to an extended length direction of said first rib member;

(b) a second rib member having opposing first and second ends, said first end of said second rib member being pivotally coupled to said runner, said inclined second end of said first rib member being pivotally coupled to a central section of said second rib member;

(c) a first stick member having opposing first and second ends, said first end of said first stick member being pivotally coupled to said first rib member, said second end of said first stick member being inclined with respect to an extended length direction of said first stick member;

(d) a second stick member having opposing first and second ends, said second stick member first end being pivotally coupled to said second rib member, said second stick member second end being inclined with respect to an extended length direction of said second stick, said second stick member having a recess formed therein for receiving said second end of said first rib member;

(e) a third rib member having opposing first and second ends, said first end of said third rib member being pivotally coupled to said second end of said second rib member and said inclined second end of said first stick member; and, (f) a fourth rib member having one end pivotally coupled to said inclined second end of said second stick member and said second end of said third rib member.

* * * * *